US008528531B2

(12) United States Patent
Nakano et al.

(10) Patent No.: US 8,528,531 B2
(45) Date of Patent: Sep. 10, 2013

(54) IGNITION APPARATUS OF PLASMA JET IGNITION PLUG

(75) Inventors: Daisuke Nakano, Kiyosu (JP); Yoshikuni Sato, Nagoya (JP); Hiroyuki Kameda, Aichi (JP); Naofumi Yamamura, Nagoya (JP); Daisuke Kasahara, Nagoya (JP)

(73) Assignee: NGK SPark Plug Co., Ltd., Aichi (JP)

( * ) Notice: Subject to any disclaimer, the term of this patent is extended or adjusted under 35 U.S.C. 154(b) by 142 days.

(21) Appl. No.: 13/201,751

(22) PCT Filed: Feb. 18, 2010

(86) PCT No.: PCT/JP2010/052471

§ 371 (c)(1),
(2), (4) Date: Aug. 16, 2011

(87) PCT Pub. No.: WO2010/095694

PCT Pub. Date: Aug. 26, 2010

(65) Prior Publication Data

US 2011/0297131 A1 Dec. 8, 2011

(30) Foreign Application Priority Data

Feb. 18, 2009 (JP) ..... P.2009-035107

(51) Int. Cl.
*H01T 15/00* (2006.01)
*H01T 13/54* (2006.01)
*F02P 3/01* (2006.01)

(52) U.S. Cl.
USPC ..... 123/596

(58) Field of Classification Search
USPC ..... 123/596–605, 169 EL, 143 B
See application file for complete search history.

(56) References Cited

U.S. PATENT DOCUMENTS 4,433,669 A * 2/1984 Ishikawa et al. ..... 123/620
5,704,321 A * 1/1998 Suckewer et al. ..... 123/143 B
6,087,871 A * 7/2000 Kardo-Syssoev et al. .... 327/189
6,131,542 A * 10/2000 Suckewer et al. ..... 123/143 B
6,474,321 B1 * 11/2002 Suckewer et al. ..... 123/620
6,553,981 B1 * 4/2003 Suckewer et al. ..... 123/620

(Continued)

FOREIGN PATENT DOCUMENTS

JP 57-028869 2/1982
JP 09-232161 9/1997

(Continued)

OTHER PUBLICATIONS

International Search Report for International Application No. PCT/JP2010/052471, May 18, 2010.

*Primary Examiner* — Stephen K Cronin
*Assistant Examiner* — Arnold Castro
(74) *Attorney, Agent, or Firm* — Kusner & Jaffe

(57) ABSTRACT

A current of sufficient size to form plasma at ignition of a plasma jet ignition plug flows to a spark discharge gap while suppressing noise occurrence.

There is provided an ignition apparatus of a plasma jet ignition plug, which includes a resistor R1, with one end connected to a diode D1 disposed between the plasma jet ignition plug 100 and a high-voltage generation circuit 210 and with the other end electrically connected to a center electrode 40 of the plasma jet ignition plug 100, and a capacitor C1, with one end connected to the center electrode 40 of the plasma jet ignition plug 100 and with the other end grounded.

4 Claims, 3 Drawing Sheets

(56) References Cited

U.S. PATENT DOCUMENTS

| | | | | |
|---|---|---|---|---|
| 6,662,793 | B1 * | 12/2003 | Allen et al. | 123/620 |
| 7,387,115 | B1 | 6/2008 | Katoh et al. | 123/620 |
| 7,895,994 | B2 * | 3/2011 | Yamada et al. | 123/618 |
| 8,033,273 | B2 * | 10/2011 | Kato et al. | 123/596 |
| 8,082,897 | B2 * | 12/2011 | Kato et al. | 123/169 EL |
| 8,316,823 | B2 * | 11/2012 | Sato et al. | 123/406.19 |
| 2007/0114901 | A1 * | 5/2007 | Nagasawa et al. | 313/141 |
| 2007/0221156 | A1 * | 9/2007 | Hagiwara et al. | 123/143 B |
| 2007/0221157 | A1 * | 9/2007 | Hagiwara et al. | 123/143 B |
| 2008/0149083 | A1 * | 6/2008 | Katoh et al. | 123/634 |
| 2009/0007893 | A1 | 1/2009 | Kato et al. | 123/596 |
| 2009/0235889 | A1 | 9/2009 | Yamada et al. | 123/143 |
| 2010/0132666 | A1 * | 6/2010 | Sato et al. | 123/406.19 |

FOREIGN PATENT DOCUMENTS

| | | |
|---|---|---|
| JP | 2002-327672 | 11/2002 |
| JP | 2008-175197 | 7/2008 |
| JP | 2009-030593 | 2/2009 |
| JP | 2009-228505 | 8/2009 |

* cited by examiner

IGNITION APPARATUS OF PLASMA JET IGNITION PLUG

TECHNICAL FIELD

Apparatuses consistent with the present disclosure relates to an ignition apparatus of a plasma jet ignition plug for an internal combustion engine performing the ignition of mixed gas by forming plasma.

BACKGROUND ART

In the related art, a spark plug performing a firing of mixed gas by spark discharge (simply referred to as 'discharge') is used for an igniting plug of an engine, for example, an internal combustion engine of automobiles. In recent years, a plasma jet ignition plug in which the expansion of combustion is speedy and which can be surely fired for lean mix gas having high igniting limit fuel efficiency has been used as an ignition plug since a high output and low fuel efficiency of an internal combustion engine are required.

In such a plasma jet ignition plug, a spark discharge gap between a center electrode and a ground electrode is formed when connected to an electric source. A plasma jet ignition plug surrounds a vicinity of this spark ignition gap using an insulator such as ceramics, and thus has a structure forming a discharge space of small volume called a cavity. A plasma jet ignition plug using an overlap type electric source is described with reference to one example (e.g., see patent document 1). In an ignition of mixed gas, first, a high voltage is applied between a center electrode and a ground electrode, and then a spark discharge (also called 'trigger discharge) is produced. Due to dielectric breakdown produced at the time of spark discharge, a current can flows between both electrodes through a relatively low voltage. Thus, more energy is provided, thereby transiting a discharge status, and therefore plasma is formed in the cavity. Further, the formed plasma is extruded through a communicating hole, so that an ignition of nixed gas is performed. One effusion of plasma corresponds to each stroke.

In such a plasma jet ignition plug, a higher current than typically used to spark discharge in a general spark plug is required to flow through the spark discharge gap when plasma is formed. In order to increase a flowing current, it is necessary to lower the electric resistance value of the circuit through which the current flows, and normally a resistor is no provided in the circuit of an ignition apparatus or inside the plasma jet ignition plug (e.g., see patent document 2).

RELATED ART DOCUMENT

Patent Document

[Patent document 1] Japanese patent publication 2002-327672-A

[Patent document 2] Japanese patent publication SHO 57-28869-A

DISCLOSURE OF THE INVENTION

Problem that the Invention is to Solve

However, since in a plasma jet ignition plug, high current flows in a short time, fluctuations in a current value per unit time are significant. Therefore, there can be a problem a large amount of electrical noise being easily (in this specification, noise, such as electric waves radiating outside from an appliance, is sometimes called 'electrical noise'. When a high frequency current flows within an electronic appliance, this electric noise is radiated, and affects external appliances or other signals with interference) attributable to stray capacity (the stray capacity is formed at a high voltage line positioned between a plasma jet ignition plug and a discharge voltage application unit applying a voltage to that plasma jet ignition plug). To suppress the occurrence of such electric noise, a resistor may be provided inside the plasma jet ignition plug or on a circuit of an ignition apparatus to suppress energy accumulated as stray capacity, but if a resistor is provided directly, a discharge current producing capacity is smaller, thus causing uncertainty whether an energy capacity discharge of sufficient size to form plasma will be obtained.

The present invention has been made considering the above facts, and it is an object of exemplary embodiments to provide an ignition apparatus of a plasma jet ignition plug that produces a current of sufficient size to form plasma but suppressing the occurrence of electric noise, at the ignition of the plasma jet ignition plug.

Means for Solving the Problem

To achieve the above-described objective, an ignition apparatus of a plasma jet ignition plug of the invention is characterized by the following (1)~(4).

(1) An ignition apparatus of a plasma jet ignition plug, comprising:

a plasma jet ignition plug including an insulator having an axis hole that extends in an axial direction and a center electrode in the axis hole, a metal shell having a cylindrical shape and holding the insulator, and a ground electrode having a plate shape and having a communication hole that communicates along the axial direction in its center;

a discharge voltage application unit applying a voltage for providing a spark discharge in a spark discharge gap, which is formed between the center electrode and the ground electrode, to the plasma jet ignition plug; and a diode disposed between the plasma jet ignition plug and the discharge voltage application unit;

wherein the ignition apparatus further includes:

a resistor, wherein one end of the resistor is connected to the diode and the other end of the resistor is electrically connected to the center electrode of the plasma jet ignition plug; and a capacitor functional component, wherein one end of the capacitor functional component is electrically connected to the center electrode of the plasma jet ignition plug and the other end of the capacitor functional component is grounded.

(2) The ignition apparatus according to the above (1), wherein the capacity functional component includes:

a terminal fitting electrically connected to the center electrode of the plasma jet ignition plug, and a metal cask having a hollow cylindrical shape and receiving the terminal fitting in an inside of the metal cask.

(3) The ignition apparatus according to the above (2), wherein the capacitor functional component has a dielectric filing a gap between the terminal fitting which is received in the metal cask and the metal cask.

(4) The ignition apparatus according to the above (2) or (3), wherein the other end of the resistor is disposed inside the metal cask, wherein electrostatic capacity is accumulated on an area sandwiched between a cross-section of the metal cask, where the other end of the resister is included, perpendicular to an axis center direction of the metal cask and a cross-section of the metal cask containing an end face of the metal cask, wherein the terminal fitting is disposed inside the area, and wherein the electrostatic capacity in the area is more than 1 pF and less than 100 pF.

According to an ignition apparatus of a plasma jet ignition plug of the above (1) construction, at the ignition of a plasma jet ignition plug, a current of sufficient size for forming plasma flows at a spark discharge gap and also occurrence of electric noise is reduced.

According to an ignition apparatus of a plasma jet ignition plug of the above (2) construction, because with respect to electric noise attributable to a newly provided capacitor, a metal cask forming the capacitor acts to shield, and the propagation of electric noise producing from the capacitor may be suppressed.

According to an ignition apparatus of a plasma jet ignition plug of the above (3) construction, by using dielectric of a desired dielectric constant, the miniaturization of this capacitor functional component may be realized.

According to an ignition apparatus of a plasma jet ignition plug of the above (4) construction, at the ignition of a plasma jet ignition plug, a current of sufficient size for forming plasma effectively flows in a spark discharge gap and also occurrence of electric noise is more effectively prevented.

Effect of the Invention

According to an ignition apparatus of a plasma jet ignition plug of the present invention, at the ignition of a plasma jet ignition plug, a current of sufficient size for forming plasma flows at a spark discharge gap and also occurrence of electric noise is prevented.

As described above, the present invention has been concisely described. Also, by carefully reading the following described preferred embodiments in reference to the annexed drawings, the details of the invention will be further elucidated.

EXEMPLARY EMBODIMENTS FOR CARRYING OUT THE INVENTION

Figure 1:
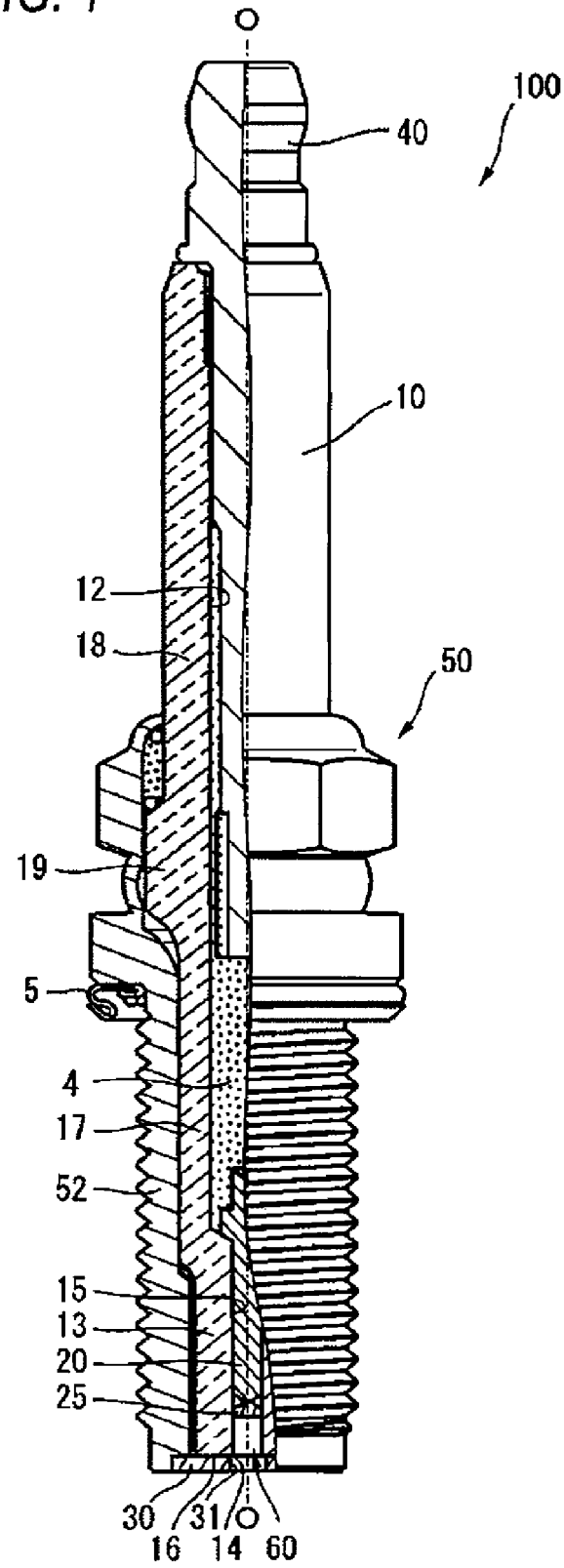
FIG. 1 is a partial cross-sectional view showing a basic structure of a plasma jet ignition plug.

Hereinafter, one embodiment of an ignition apparatus for a plasma jet ignition plug according to the present invention will be described with reference to drawings. First, a plasma jet ignition plug 100 will be described. A basic structure of a plasma jet ignition plug 100 usable in an ignition apparatus 200 of the present invention is shown in FIG. 1. In FIG. 1 an axis direction O of the plasma jet ignition plug 100 is defined as an upward/downward direction in the figure, the lower side is described as a frond end side of the plasma jet ignition plug 100, and the upper side is described as a back end side.

The plasma jet ignition plug 100 shown in FIG. 1 is formed from an insulating member obtained by sintering alumina using a well known method, and has an insulator 10 of cylindrical shape formed with a shaft hole 12 extending in an axis direction O. The insulator 10 has a center body part 19, which has a biggest outer diameter and is centered in the axis direction O. At the back end side of this center body part 19, a back end side body part 18 having a diameter smaller than the center body part 19 is formed. Also, a front end side body part 17 with a smaller outer diameter than the back end side body part 18 is formed in a more front end side than the center body part 19. Also, a long leg section 13 with a smaller outer diameter than the front end side body part 17 is formed in a more front end side of the front end side body part 17. Further a part corresponding to an inner-rim of the long leg section 13 of the shaft hole 12 of the insulator 10 is as a smaller diameter than other parts of the shaft hole 12 and is formed to be an electrode reception part 15. An inner-rim of this electrode reception part 15 is contiguous to a front end surface 16 of the insulator 10, and forms an opening part 14 of a later-described cavity 60.

At the inner part of the electrode reception part 15, a bar-type center electrode 20, which uses Cu or Cu alloy as a center material and has Ni alloy as a shell is provided. A structure formed by bonding a discus-type electrode tip 25, which is formed of an alloy having noble metal or W as a main ingredient, at the front end of the center electrode 20 or is formed integrally with the center electrode 20 may also be used (in the present embodiment, a formation of the center electrode 20 integrated with the electrode tip 25 is also called the 'center electrode'). Herein, a low volume discharge space is enclosingly formed at an inner-rim of the electrode reception part 15 of the shaft hole 12, and the front end surface of the center electrode 20 (or, a front end surface of an electrode tip 25 integrally bonded to the center electrode 20). In the present embodiment, this discharge space is called a cavity 60. Also, the center electrode 20 extends toward a back end side in the shaft bore 12, and electrically connected to a terminal fitting 40 provided at the back end side of the shaft bore 12 via a conductive sealed body formed of mixture of metal and glass. The terminal fitting 40 is connected to a high-voltage cable (not shown) through a plug cap (not shown), and constructed to receive a high-voltage from a later-described ignition apparatus 200 (see FIG. 3).

Also, a part of the insulator 10 from a portion of the back end side body section 18 to the long leg part 13 is supported by a metal shell 50 that is formed in a tubular shape using ferrous material, and the insulator 10 is supported by the crimping portion of the metal shell 50. The metal shell 50 has a screw attachment part 52 having a screw thread for screw connection with an attachment hole 301 of the engine head 300. Further, a proximal end side of the attachment screw part 52 is surrounded by a ring-shape gasket 5 to prevent a leakage of air tightness inside the engine through the attachment hole, when the plasma jet ignition plug 100 is attached to the attachment hole of the engine head 300.

A front end of the metal shell 50 is provided with a disk shaped ground electrode 30 formed using Ni alloy having a superior spark-proof composition such as INCONEL™ 600 or 601. The ground electrode 30 is integrally bonded with the metal shell 50, in a state that the ground electrode 30 contacts the front end surface 16 of the insulator 10 with its thickness direction oriented in a line with the axis direction O. The center of the ground electrode 30 is formed with a communication hole 31, axially aligned with the opening part 14 of the cavity 60, and through this communication hole 31 the inner part of the cavity 60 communicates with the open air. Between the ground electrode 30 and the center electrode 20 is formed as a spark discharge gap, and the cavity 60 is formed to enclose at least this part. When a spark discharge is performed in this spark discharge gap, energy is supplied so that plasma is formed in the cavity 60, and this plasma is extruded from the opening part 14 through the communication hole 31.

Figure 2:
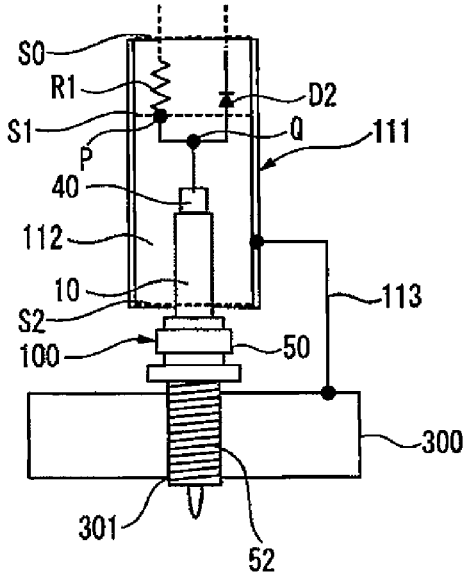
FIG. 2 is a partial cross-sectional view showing an exemplary structure of a plasma jet ignition plug used in the invention.
Figure 3:
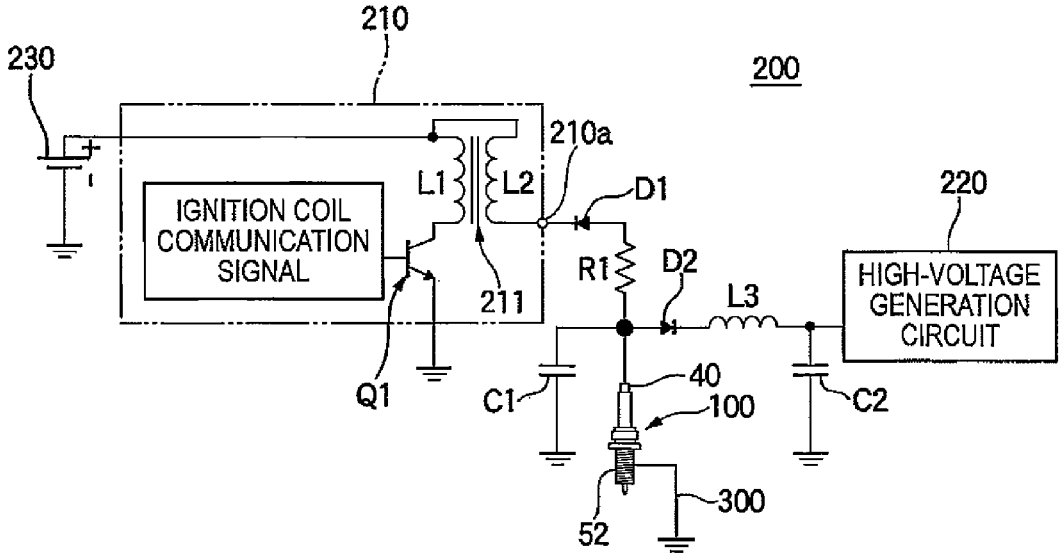
FIG. 3 is an electric circuit view showing an exemplary structure of an ignition apparatus using a plasma jet ignition plug indicated in FIG. 2.

In addition to components shown in FIG. 1, a plasma jet ignition plug 100 used in the ignition apparatus 200 of the present embodiment also has components corresponding to a capacitor C1 shown in FIG. 3 For example, as shown in FIG. 2, the plasma jet ignition plug 100 also has a tubular electrode 111 and a dielectric 112, and the tubular electrode 111 and the dielectric 112 form the capacitor C1.

The tubular electrode 111 is comprised of conductive metal material, and formed to have a hollow structure with a tubular shape. The inner diameter of the tubular electrode 111 is greater than a diameter of the back end side body part 18 of the insulator 10. The tubular electrode 111 is disposed to enclose and surround the back end side body part 18 of the insulator 10 and disposed the center axis of the tubular electrode 111 aligned with the center axis of the back end side body part 18. As illustrated in FIG. 2, a length of the axis direction of the tubular electrode 111 is about two times a length of the back end side body part 18. A lower half side region of the tubular electrode 111 encloses the outer-rim of the back end side body part 18. Thus, the tubular electrode 111 extends further up toward the upper part of the plasma jet ignition plug than the back end side body part 18.

A space between either the insulator 10 or the terminal fitting 40 and the tubular electrode 111 is filled with dielectrics 112. The dielectric 112 is comprised of electric insulators having dielectric properties. The dielectric 112 is comprised of higher dielectric material than the insulator 10.

The terminal fitting 40 of the conductor and the tubular electrode 111 enclosing the conductor face each other with the dielectric interposed there between, thereby which electrostatic capacity, i.e. a circuit component corresponding to the capacitor C1 shown in FIG. 3, is formed. It is preferable that the size of the electrostatic capacity of the capacitor C1 formed in the plasma jet ignition plug 100 be more than 1 pF and less than 100 pF. However, even though in an embodiment of the present invention, a structure filled with dielectric 112 in a space between the terminal fitting 40 and the tubular electrode 111 is described, it is not necessary that the structure be filled with the dielectric 112. It is required only that a size of electrostatic capacity of the capacitor C1 is more than 1 pF and less than 100 pF.

Originally, for example, a member, such as the terminal fitting 40, and a ground side, such as the ground electrode 30, is formed with a relatively small stray capacity (not shown) there between. The stray capacity greatly affects a discharge action in the plasma jet ignition plug 100. In the present embodiment, in order to provide a more secured discharge action, the tubular electrode 111 and the dielectric 112 are provided. Thus, by providing the tubular electrode 111 and the dielectric 112, a capacitor C1 having a larger value than the stray capacitor is formed in the vicinity of the center electrode 20.

As illustrated in FIG. 2, the plasma jet ignition plug 100 is installed to fit (screw connection) into the engine head 300 of an internal combustion engine with the attachment screw part 52 formed with metal. The tubular electrode 111 provided at the plasma jet ignition plug 100 is electrically connected to the engine head 300 by a wiring 113, and connected through the engine head 300 to the ground.

As illustrated in FIG. 2, the terminal fitting 40 is connected with the other end of a resistor R1 and one end (anode) of a diode D2. In an example shown in FIG. 2, the resistor R1 and the diode D2 are disposed within a space of the inner side of the tubular electrode 111. Further, the other end P of that resistor R1 (the other end of the resistor R1 is an end part opposite to a resistor R1 connected to the diode D1; This end part is called nexus point P in some cases) is also disposed in a space of the inner part of the tubular electrode 111. On the one hand, FIG. 3 recites that one end of a resistor R1 is connected to an anode of a diode disposed between the plasma jet ignition plug 100 and a later-described high-voltage generation circuit 210 (also, called a discharge voltage application unit in some cases), but the present invention is not restricted to one end of a resistor R1 connected to an anode. According to a circuit construction of the ignition apparatus 200, it may alternatively be properly connected to a cathode.

When an electric discharge occurs at the plasma jet ignition plug 100, high-frequency current flows through the circuit including the terminal fitting 40, in a short time and electrical noise caused by the high-frequency current, that is electric waves, radiates out of the plasma jet ignition plug 100 to affect the surrounding electronic devices. However, with respect to noise occurring nearby the terminal fitting 40, which surrounded and covered with a grounded tubular electrode 111, the radiation of the noise toward the outside is steeply suppressed by an electrostatic shield effect.

The plasma jet ignition plug 100 having such a structure forms plasma in the cavity 60 by connecting to the ignition apparatus 200 shown in FIG. 3 and being provided with energy, and extrudes plasma from the opening part 14 and ignites the mixed gas. Hereinafter, referring to FIG. 3, the ignition apparatus 200 of the plasma jet ignition plug 100 will be explained.

As shown in FIG. 3, the ignition apparatus 200 has two high-voltage generation circuits 210, 220. The high-voltage generation circuit 210 on one side (called a discharge voltage application unit in some cases) is an electric source for performing a spark discharge between the center electrode 20 and the ground electrode 30 of the plasma jet ignition plug 100, and can temporarily output about several tens of kV of high voltage. A high-voltage generation circuit 220 on the other side is an electric source for supplying electric energy needed for producing of plasma to the plasma jet ignition plug 100 after a spark discharge has occurred, and outputs about 500 V of high-voltage. With the electric power supplied from the high-voltage generation circuit 210 and power supplied from the high-voltage generation circuit 220, plasma from the opening part 14 of the plasma jet ignition plug 100 extrudes towards an inner side space of the engine head 300, and by this plasma, an ignition to mixed gas is performed.

The high-voltage generation circuit 210 shown in FIG. 3 has an ignition coil 211 and a transistor Q1. The ignition coil 211 is a high-voltage transformer having a primary coil L1 and a secondary coil L2. In the primary coil L1 of the ignition coil 211, one end is connected to a plus terminal of a DC electric source 230 (including batteries, etc.), and the other end is connected to a collector terminal of the transistor Q1. The minus terminal of the DC source 230 is connected to the ground.

A control terminal of the transistor Q1, that is a base electrode, is applied with an ignition coil electric current signal from a control circuit that is not shown. The ignition coil electric current signal is a signal having one pulse signal per 1 discharge cycle in the plasma jet ignition plug 100, and used in a switching control of the transistor Q1.

Thus, when the ignition coil current signal becomes a high-level, the transistor Q1 conducts, and current flows to the primary coil L1 of the ignition coil 211 from power supplied by the DC source 230. Also, when the ignition coil current signal becomes a low-level, the transistor Q1 does not conduct, and the current flowing through the primary coil L1 of the ignition coil 211 is abruptly blocked.

When a current starts to flow through the primary coil L1 of the ignition coil 211, and when the current of the primary coil L1 of the ignition coil 211 is blocked, a high-voltage is produced at the secondary coil L2. The voltage producing at the secondary coil L2 is determined by a ratio of the winding number of the primary coil L1 and the secondary coil L2.

As shown in FIG. 3, an output terminal 210*a* of the high-voltage generation circuit 210 is connected to the cathode terminal, that is one end of the diode D1, and the anode, that is the other end of the diode D1, connects to one end of the resistor R1, and the other end of the resistor R1 is electrically connected to the terminal fitting 40 of the plasma jet ignition plug 100. The Diode is provided to prevent a counter-flow of current. That is, in order that current at a spark discharge flows only in a direction from the terminal fitting 40 to the secondary coil L2 by a negative voltage, the diode D1 controls a polarity. A resistor value of more than 100Ω is preferred for the resistor R1. Like the structure of a normal plasma jet ignition plug, the plasma jet ignition plug 100 according to an exemplary embodiment does not have a special resistor inside.

A capacitor C2 is connected between an output terminal and a ground terminal of the high-voltage generation circuit 220. Also, the output terminal of the high-voltage generation circuit 220 is connected with one end of a coil L3, and the other end of the coil L3 is connected with one end of the diode D2, that is a cathode terminal, and the other end of the diode D2, that is an anode terminal, is electrically connected to the terminal fitting 40 of the plasma jet ignition plug 100. The diode D2 is provided to prevent the counter-flow of a current. That is, in order to ensure current at plasma discharge flows only in a direction from the terminal fitting 40 towards the output side of the high-voltage generation circuit 220 by a negative voltage, the diode D2 controls polarity. Further, a DC resistive value such as the coil L3 in a wiring connecting a capacitor C2 to the terminal fitting 40 of the plasma jet ignition plug 100 is less than 1Ω.

Figure 4:
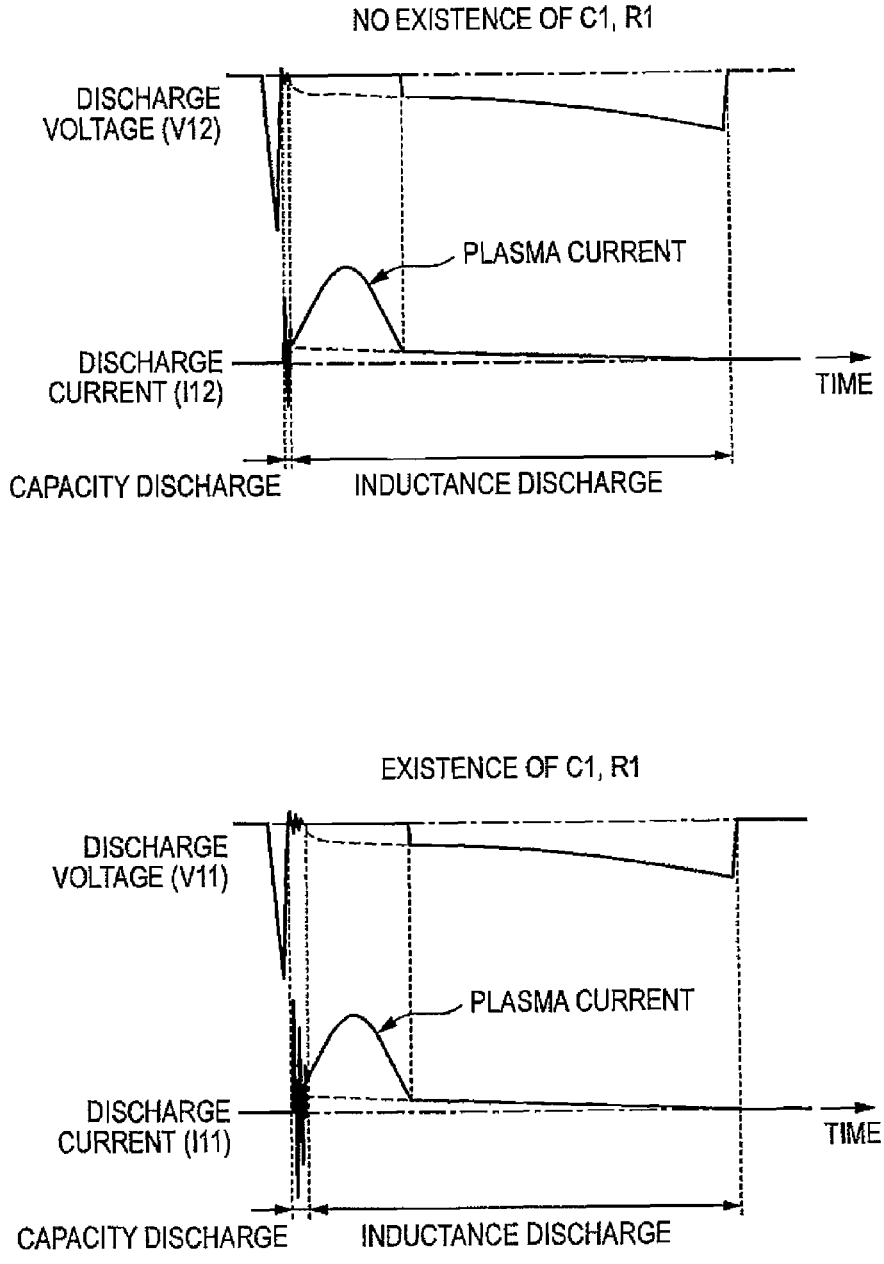
FIG. 4 is a waveform view showing a specific example of waveforms of a discharge voltage and a discharge current applied to a plasma jet ignition plug.

A specific example of waveforms of a discharge current flowing at discharge and a discharge voltage applied to the plasma jet ignition plug 100 during one cycle of a discharge action are shown in FIG. 4. Discharge voltage V11 and discharge current I11 shown in FIG. 4 indicate a case of having the resistor R1 and the capacitor C1 as illustrated in FIG. 3, and discharge voltage V12 and discharge current I12 indicate a waveform not existing with the resistor R1 and the capacitor C1 as illustrated in FIG. 3.

When a discharge is started, first in order to produce a spark discharge (referred to as a trigger discharge), a high-voltage from the high-voltage generation circuit 210 is supplied to the plasma jet ignition plug 100. That is, the transistor Q1 shown in FIG. 3 converts from a conducting state to a non-conducting state, the secondary coil L2 of the ignition coil 211 instantly has a high-voltage, this high-voltage comes up at the output 210*a* of the high-voltage generation circuit 210 as a negative voltage against the ground potential, and this high-voltage is applied to the terminal fitting 40 of the plasma jet ignition plug 100 through the diode D1 and the resistor R1.

Electrostatic capacity other than the capacitor C1, i.e. stray capacity, exists between electrodes inside the plasma jet ignition plug 100, between the ground and a high-voltage cable (a wiring including D1, R1) connecting the high-voltage generation circuit 210 and the plasma jet ignition plug 100, and between the secondary coil L2 of the ignition coil 211 and the ground.

When the output 210*a* of the high-voltage generation circuit 210 instantly has a high-voltage, electric charge is accumulated at each point of stray capacity or the capacitor C1 by the high-voltage. In an initial stage of the plasma jet ignition plug 100 (a timing of 'capacity discharge' shown in FIG. 4: about several nanoseconds), a dielectric break down in the cavity 60 is induced by a high voltage and a spark discharge occurs, but by the emitting of electric charge accumulated at each point of each stray capacity or the capacitor C1, electric energy is supplied into the plasma jet ignition plug 100. Also, after the electric charge of each stray capacitor or the capacitor C1 is emitted ('a timing of induced discharge' shown in FIG. 4: about several μsec), energy accumulated on inductance of the secondary coil L2 of the ignition coil 211 is emitted and continues the discharge.

Meanwhile, to produce plasma by discharge, it is necessary to supply high electric energy into the plasma jet ignition plug 100. Because a current that can be supplied from the high-voltage generation circuit 210 to the plasma jet ignition plug 100 is relatively small, energy to produce plasma is supplied from the high-voltage generation circuit 220 of a separate circuit. Actually, power outputted by the high-voltage generation circuit 220 is accumulated on the capacitor C2, and then electric charge of the capacitor C2 is supplied through the diode D2 and the coil L3 into the plasma jet ignition plug 100. When performing a plasma discharge subsequent to the spark discharge, an electric discharge production becomes easy by a dielectric breakdown occurring at the spark discharge, so that a discharge can continue even at a relatively low voltage.

When a negative voltage applied to the terminal fitting 40 of the plasma jet ignition plug 100 from the high-voltage generation circuit 210 side is smaller than a negative voltage appearing at terminals of the capacitor C2 connected to the high-voltage generation circuit 220, the diode D2 conducts, and electric charge accumulated on the capacitor C2 is supplied into the plasma jet ignition plug 100 through the diode D2 and the coil L3. That is, a current (also called plasma current) flowing by plasma occurring in the cavity 60 of the plasma jet ignition plug 100 dribbles into the capacitor C2 via the diode D2 and the coil L3 from the terminal fitting 40.

Thus, as the waveform shown in the discharge current I11 of FIG. 4, a plasma current starts to flow in the middle of a timing of 'capacity discharge', and proportionate to an amount of electric charge accumulated on the capacitor C2, the plasma current continuously flows.

However, during the timing of 'capacity discharge', a high-amplitude high-frequency current electric charge caused by of a high-voltage appears for a very short time on a waveform of a discharge current. When noise such as electric waves radiates from the high-frequency current, the radiated noise adversely affects electronic devices surrounding the ignition apparatus 200. Therefore, noise radiated from the ignition apparatus 200 needs to be prevented.

In the ignition apparatus 200 having a construction as shown in FIG. 3, as the stray capacitance and the discharge voltage increase, current at 'capacitor discharge' rises, and radiated noise also increases. Also, as a DC resistor existing in a path through which a current at 'capacity discharge' flows becomes smaller, a current at 'capacitor discharge' rises, and radiated noise also increases.

In the meantime, when a current at 'capacity discharge' is small, it is difficult for plasma current to flow into the plasma jet ignition plug 100 at a plasma discharge. That is, when a current of 'capacity discharge' is small, a time needed to emit electric charge accumulated on the points of stray capacity gets longer, and a time in which a negative high-voltage applied to the plasma jet ignition plug 100 from the high-voltage generation circuit 210 side decays becomes longer. If this high-voltage has not sufficiently decayed, the diode D2 does not conduct, so that it is impossible to supply electric charge of the capacitor C2 to the plasma jet ignition plug 100 for plasma discharge.

Also, for a plasma current through line (a current path having the diode D2, the coil L3, etc.), it is desirable to keep a DC resistor small. By this, a peak value of the plasma current becomes larger, so that a production efficiency of plasma is improved.

A resistor R1 inserted between the output of the high-voltage generation circuit 210 and the terminal fitting 40 of the plasma jet generation plug 100 suppresses an amplitude of a high-frequency current flowing at 'capacity discharge' by a high-voltage cable connecting the high-voltage generation circuit 210 and the plasma jet ignition plug 100 and electric charge accumulated on stray capacitance of the secondary coil L2 of the ignition coil 211, thereby having an effect of saving the above-described noise.

However, by providing the resistor R1, a current at 'capacity discharge' becomes smaller, a time until when a high-voltage applied to the terminal fitting 40 decays as described above becomes longer, and it is difficult to flow a current of the capacitor C2 into the plasma jet ignition plug 100 at a plasma discharge.

As illustrated in FIG. 3, by connecting the capacitor C1 to the plasma jet ignition plug 100, even in a case the resistor R1 exists, it is easy to flow a current of the capacity C2 at plasma discharge into the plasma jet ignition plug 100. That is, by an addition of stray capacitance existing in the plasma jet ignition plug 100 itself and capacitance of the capacitor C1, increasing the current at capacity discharge, it is easy to flow a current of the capacitor C2 at plasma discharge into the plasma jet ignition plug 100. Further after a high-voltage from an output of the high-voltage generation circuit 210 is applied to the plasma jet ignition plug 100, electric discharge accumulated on the capacitor C1 is swiftly emitted through a path with a small resistor value (between electrodes of the plasma jet ignition plug 100), a high-voltage applied to the terminal fitting 40 decays fast, and in a short time the diode D2 conducts and thus a plasma current starts to flow.

Therefore, the capacitor C1 needs to be disposed at a position near the terminal fitting 40 rather than the resistor R1. In addition, since a very high voltage is applied from the high-voltage generation circuit 210, a high internal pressure (several tens of kV) is required for the capacitor C1. Due to this, it is difficult to use a general capacitor selling on the market as the capacitor C1. Thus, as shown in FIG. 2, by disposing the tubular electrode 111 near the terminal fitting 40 and filling dielectric 112 between them, a capacitor C1 having a sufficiently high capacitance is constructed.

For electrostatic capacity of the capacitor C1, more than 1 pF and less than 100 pF is suitable. In particular, as shown in FIG. 2, when a point P, that is the other end of the resistor R1, is disposed in an inner space of the tubular electrode 111, the point P, the other end of that resistor R1, is contained, and electrostatic capacity accumulated on a sandwiched area between a cross-section S1 of the tubular electrode 111 perpendicular to an axis center direction of the tubular electrode 111 and a cross-section S2 of the tubular electrode 111 containing a cross-section of the tubular electrode 111 has preferably more than 1 pF and less than 100 pF. Note the cross-section of the tubular electrode 111 is a surface in which an end part of the tubular electrode 111 places on the same plane, and have a side to which the plasma jet ignition plug 100 is inserted and penetrated and a side not inserted and penetrated. Also note this area is sandwiched by the cross-section S2 of the tubular electrode 111 containing the cross-section of the tubular electrode 111 placed at the side inserted and penetrated by the plasma jet ignition plug 100, and its inside has the terminal fitting 40. The electrostatic capacity accumulated on an area sandwiched between the above-described cross-section S1 and the cross section S2 is equivalent to electrostatic capacity accumulated on the capacitor C1 of FIG. 3, and electric energy by discharge of electric discharge accumulated on this area is supplied to the plasma jet ignition plug 100.

Meanwhile electric charge is also accumulated in an area sandwiched between a cross-section S0 of the tubular electrode 111 containing the cross-section of the tubular electrode 111 (a cross-section containing a cross-section of the tubular electrode 111 at the side to which the plasma jet ignition plug 100 is not inserted and penetrated, positioned opposite to the above-described cross-section S2) and the above-described cross-section S1 of the tubular electrode 111. However, electric energy by discharge of this electric charge is supplied to the resistor R1 placed in this area, but not supplied to the plasma jet ignition plug 100. Because of this, in order to make it easy for a current of the capacitor C2 to flow at plasma discharge into the plasma jet ignition plug 100, it is significantly necessary to take action by emitting electric charge accumulated in an area sandwiched between the above-described cross-section S1 and the cross-section S2), and thus, it is proper that electrostatic capacity accumulated in the area is more than 1 pF and less than 100 pF.

Electrostatic capacity accumulated in an area between the above-described cross-section S1 and the cross-section S2 may be, for example, specified by cutting a part from the cross-section S0 to the cross-section S1 of the tubular electrode 111 and measuring electrostatic capacity of the remaining tubular electrode 111 by an LCR meter. On the one hand, a method of specifying electrostatic capacity is not limited to this. It may be theoretically calculated in reference to a shape and its inner dielectric of the tubular electrode 111, a position of the other end of the resistor R1 inside the tubular electrode 111, and a shape and its dielectric of the plasma jet ignition plug 100 placed inside the tubular electrode 111.

In a case electrostatic capacity of the capacitor C1 is less than 1 pF, an effect of the capacitor C1 is not sufficiently obtained, but it is difficult for a current of the capacitor C2 to flow at plasma discharge into the plasma jet ignition plug 100. Specifically, in a case electrostatic capacity of the capacitor C1 is less than 1 pF, a probability that plasma is formed in the cavity 60 (plasma occurrence probability) is lowered to 70~80%. Also, in a case electrostatic capacity of the capacitor C1 exceeds 100 pF, when a high-voltage from an output of the high-voltage generation circuit 210 is applied to the terminal fitting 40, a rising velocity of a voltage slows by a relaxation time of R1, C1, and it may not be possible for capacity discharge. Specifically, in a case electrostatic capacity of the capacitor C1 exceeds 100 pF, a probability that capacity discharge occurs by the plasma jet ignition plug 100 (discharge probability) lowers to 70-80%. On the one hand, when electrostatic capacity of the capacitor C1 is more than 1 pF and less than 100 pF, both a plasma occurrence probability and a discharge probability can be a high-level, that is 80-100%.

For an electrode constructing the capacitor C1, it is not limited to a cylindrical-shape such as the tubular electrode 111, but for example, an electrode of metal having a plane shape is also possible. However, in a case of using an electrode enclosing the surrounding of the terminal fitting 40 such as the tubular electrode 111 and grounding this, an effect of electrostatic shield can be obtained. That is, because an electric potential of the tubular electrode 111 is constant, noise occurring by a high-frequency current flowing through a part such as the terminal fitting 40 may not radiate to the outside of the tubular electrode 111. Noise occurring at 'capacity discharge' by stray capacitance existing in the secondary coil L2 of the ignition coil 211 or a high-pressure cable, because a current is suppressed by an effect of the resistor R1, becomes relatively smaller. It is suitable that a resistive value of the resistor R1 is more than 100Ω.

To sufficiently lower noise by an effect of the resistor R1, it is desirable that a length of a current path through which a high-frequency current flows that can cause noise may possibly shorten. Specifically, for a wiring distance from a fitting part of the plasma jet ignition plug 100 and the engine head 300 to the resistor R1, and a wiring distance from the fitting part to the diode D2, each may be less than 30 cm. Also, a wiring distance from the resistor R1 to the diode D2 may be less than 10 cm. For example, as illustrated in FIG. 2, when the resistor R1 and the diode D2 at the inner space of the tubular electrode 111 are disposed, a nearly overall of current path through which a high-frequency current flows that can be the cause of noise becomes electrostatic shielded, so that an effect of noise lowering gets very high.

As to a position connected with the capacitor C1, it is better to be on a path between a connecting point Q of the resistor R1 and the diode D2 and an electrode of the plasma jet ignition plug 100 (the terminal fitting 40, etc.).

Further, electrostatic capacity of the capacitor C2 is set in order that a sum of energy at plasma formation, which is energy content supplied by stray capacitance or the capacitor C1 at trigger discharge, for a spark discharge gap, and energy content supplied from the capacitor C2, equals a supplied amount by performing one time plasma extrusion (e.g., 150 mJ). By this energy, plasma of a fire pillar shape (frame shape) can be extruded from the opening part 14, and an ignition of mixed gas by plasma can be performed.

While embodiments of the present invention has been described in detail and also in reference to a specific embodiment, it is clear to those skilled in the art that several modifications and changes can be without departing from the scope and spirit of the present invention.

This application is based on Japanese Patent Application 2009-035107 filed on Feb. 18, 2009, the content of which is hereby encompassed in reference.

DESCRIPTION OF REFERENCE NUMERALS AND SIGNS

4: seal body
5: gasket
10: insulator
12: axis hole
13: long leg part
14: opening part
15: electrode reception part
16: front end part
17: front end side body part
18: back end side body part
19: center body part
20: center electrode
25: electrode tip
30: ground electrode
31: communication hole
40: terminal fitting
50: metal shell
52: attachment screw part
60: cavity
100: plasma jet ignition plug
111: tubular electrode
112: dielectric
113: wiring
200: ignition apparatus
210, 220: high-voltage generation circuit
211: ignition coil
230: DC source
300: engine head

The invention claimed is:

1. An ignition apparatus of a plasma jet ignition plug, comprising:

a plasma jet ignition plug including an insulator having an axis hole that extends in an axial direction and a center electrode in the axis hole, a metal shell having a cylindrical shape and holding the insulator, and a ground electrode having a plate shape and having a communication hole that communicates along the axial direction in its center;

a discharge voltage application unit applying a voltage for providing a spark discharge in a spark discharge gap, which is formed between the center electrode and the ground electrode, to the plasma jet ignition plug; and a diode disposed between the plasma jet ignition plug and the discharge voltage application unit;

wherein the ignition apparatus further includes:

a resistor, wherein one end of the resistor is connected to the diode and the other end of the resistor is electrically connected to the center electrode of the plasma jet ignition plug; and a capacitor functional component, wherein one end of the capacitor functional component is electrically connected to the center electrode of the plasma jet ignition plug and the other end of the capacitor functional component is grounded, said capacitor functional component including:

a terminal fitting electrically connected to the center electrode of the plasma jet ignition plug, and a metal cask having a hollow cylindrical shape and receiving the terminal fitting in an inside of the metal cask.

2. The ignition apparatus according to claim 1, wherein the capacitor functional component has a dielectric filling a gap between the terminal fitting and the metal cask.

3. The ignition apparatus according to claim 1, wherein the other end of the resistor is disposed inside the metal cask, wherein electrostatic capacity is accumulated on an area sandwiched between a cross-section of the metal cask, where the other end of the resister is included, perpendicular to an axis center direction of the metal cask and a cross-section of the metal cask containing an end face of the metal cask, wherein the terminal fitting is disposed inside the area, and wherein the electrostatic capacity in the area is more than 1 pF and less than 100 pF.

4. The ignition apparatus according to claim 2, wherein the other end of the resistor is disposed inside the metal cask, wherein electrostatic capacity is accumulated on an area sandwiched between a cross-section of the metal cask, where the other end of the resister is included, perpendicular to an axis center direction of the metal cask and a cross-section of the metal cask containing an end face of the metal cask, wherein the terminal fitting is disposed inside the area, and wherein the electrostatic capacity in the area is more than 1 pF and less than 100 pF.

* * * * *